US007456587B2

(12) United States Patent
Lin

(10) Patent No.: US 7,456,587 B2
(45) Date of Patent: Nov. 25, 2008

(54) DIGITAL CONTROLLED LIGHT SOURCE DRIVING APPARATUS

(75) Inventor: Feng-Li Lin, Taishan Township, Taipei County (TW)

(73) Assignee: Gigno Technology Co., Ltd., Taipei (TW)

( * ) Notice: Subject to any disclaimer, the term of this patent is extended or adjusted under 35 U.S.C. 154(b) by 132 days.

(21) Appl. No.: 11/480,889

(22) Filed: Jul. 6, 2006

(65) Prior Publication Data

US 2007/0035904 A1 Feb. 15, 2007

(30) Foreign Application Priority Data

Aug. 9, 2005 (TW) ..... 94127010 A

(51) Int. Cl.
*H05B 37/02* (2006.01)

(52) U.S. Cl. ..... 315/291; 315/225; 315/307

(58) Field of Classification Search ..... 315/209 R, 315/282, 276, 291, 307, 225, 320
See application file for complete search history.

(56) References Cited

U.S. PATENT DOCUMENTS 5,854,543 A * 12/1998 Satoh et al. ..... 315/307
6,654,268 B2 * 11/2003 Choi ..... 363/134
6,864,644 B2 * 3/2005 Kernahan ..... 315/307
7,009,348 B2 * 3/2006 Mogilner et al. ..... 315/307
7,015,682 B2 * 3/2006 Santin et al. ..... 323/285

* cited by examiner

*Primary Examiner*—Douglas W. Owens
*Assistant Examiner*—Jimmy T Vu
(74) *Attorney, Agent, or Firm*—Birch, Stewart, Kolasch & Birch, LLP

(57) ABSTRACT

A digital controlled light source driving apparatus includes a digital processor and a step-up circuit. The digital processor has a digital switching-signal generating module and a protecting module. The digital switching-signal generating module generates at least one digital switching signal set. The protecting module generates one protecting switching signal set according to the digital switching signal set. The step-up circuit is electrically connected to the protecting module and generates a power signal according to the protecting switching signal set.

20 Claims, 6 Drawing Sheets

DIGITAL CONTROLLED LIGHT SOURCE DRIVING APPARATUS

BACKGROUND OF THE INVENTION

1. Field of Invention

The invention relates to a light source driving apparatus, and, in particular, to a digital controlled light source driving apparatus.

2. Related Art

Flat panel displays have become increasingly popular in recent years, with liquid crystal displays (LCDs) garnering the most widespread acceptance. As manufacturing technology has developed, the maximum display size of the LCD is continuously upgraded for different purposes, including use as a TV display. When employed for this purpose, a flat panel LCD with a screen size of 30" or larger is desirable. Accordingly, an LCD of this size requires a greater number of lights to provide adequate brightness.

When the number of lights is increased, however, an accompanying problem of poor brightness uniformity between lights arises. In addition, the number of light driving apparatuses for driving the lights is also increased. For example, regarding the conventional light driving apparatus, usually only two cold cathode fluorescent lamps (CCFLs) can be driven at the same time by one transformer. Thus, for an LCD with a large screen size requiring increased number of lights, the number of required light driving apparatuses is also increased, and manufacturing costs thereof increase as a result.

As previously mentioned, the conventional LCD typically employs CCFLs as backlights thereof. To induce the CCFL or CCFLs to emit light, a light driving apparatus, such as an inverter, is typically used.

Referring to FIG. 1, a conventional light driving apparatus 1 mainly includes a current adjusting circuit 11, an oscillation step-up circuit 12, a detecting circuit 13, and a feedback control circuit 14.

The current adjusting circuit 11 is controlled by the feedback control circuit 14 and properly adjusts an external DC source, which is then input to the oscillation step-up circuit 12. The oscillation step-up circuit 12 converts the input DC source into an AC signal and amplifies the AC signal. The amplified AC signal is then provided to the CCFL 2, which serves as the light, so that the CCFL 2 can then emit light. Furthermore, the detecting circuit 13 detects a feedback signal, such as a current signal or a voltage signal, from one end of the CCFL 2. The feedback signal is then transmitted to the feedback control circuit 14. The feedback control circuit 14 controls the current adjusting circuit 11 according to the feedback signal, so that the current adjusting circuit 11 can output a suitable current level. It should be noted that the conventional feedback control circuit 14 is an analog feedback control circuit.

Recently, the manufacturer has developed a method of driving a light source in a digital controlled manner. Referring to FIG. 2A, a light source driving apparatus 3 includes a digital controlled circuit 31 and a plurality of oscillation step-up circuits 32.

The digital controlled circuit 31 generates a plurality of digital switching signal sets to be respectively inputted to the oscillation step-up circuits 32 such that the oscillation step-up circuits 32 generate an alternating signal to drive a CCFL 2 to emit light.

As shown in FIG. 2B, the oscillation step-up circuit 32 typically includes two transistors 321 and 322 for receiving the digital switching signal sets generated by the digital controlled circuit 31 to control the on/off operations and thus to control a transformer 323 to generate the alternating signal to drive the cold cathode fluorescent lamp 2. However, the transistors 321 and 322 in the oscillation step-up circuit 32 have one property. The property is that the two transistors 321 and 322 cannot be turned on simultaneously, or the transistors 321 and 322 may be burned out due to the short-circuited phenomenon. The digital switching signal set generated by the digital controlled circuit 31 may cause the two transistors 321 and 322 to receive the turn-on signal simultaneously due to the crash in the digital processing step. Thus, the transistors 321 and 322 may be burned out to cause the serious result of the disabled light source driving apparatus 3.

Thus, it is an important subject of the invention to ensure the light source driving apparatus to work normally.

SUMMARY OF THE INVENTION

In view of the foregoing, the invention is to provide a digital controlled light source driving apparatus capable of ensuring the light source driving apparatus to work normally.

To achieve the above, the invention discloses a digital controlled light source driving apparatus including a digital processor and a step-up circuit. The digital processor has a digital switching-signal generating module and a protecting module and generates at least one digital switching signal set. The protecting module generates one protecting switching signal set according to the digital switching signal set. The step-up circuit is electrically connected to the protecting module and generates a power signal according to the protecting switching signal set.

As mentioned hereinabove, the digital controlled light source driving apparatus of the invention generates the digital switching signal set by the digital processor and then modulates the digital switching signal set into the protecting switching signal set by the protecting module. Then, the protecting switching signal set is inputted to the step-up circuit to ensure the step-up circuit to work normally when the digital processor generates the error digital switching signal set.

To achieve the above, the invention also discloses a digital controlled light source driving apparatus including a digital processor, a protecting circuit and a step-up circuit. The digital processor has a digital switching-signal generating module capable of generating at least one digital switching signal set. The protecting circuit is electrically connected to the digital processor and generates one protecting switching signal set according to the digital switching signal set. The step-up circuit is electrically connected to the protecting circuit and generates a power signal according to the protecting switching signal set.

As mentioned hereinabove, the digital controlled light source driving apparatus of the invention generates the digital switching signal set by the digital processor and then modulates the digital switching signal set into the protecting switching signal set by the protecting circuit. Then, the protecting switching signal set is inputted to the step-up circuit to ensure the step-up circuit to work normally when the digital processor generates the error digital switching signal set.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
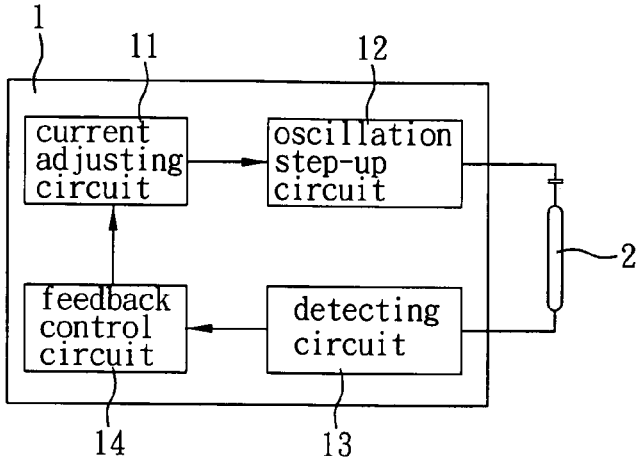
FIG. 1 (PRIOR ART)
FIG. 1 is a schematic block diagram showing a conventional light source driving apparatus.
Figure 2A:
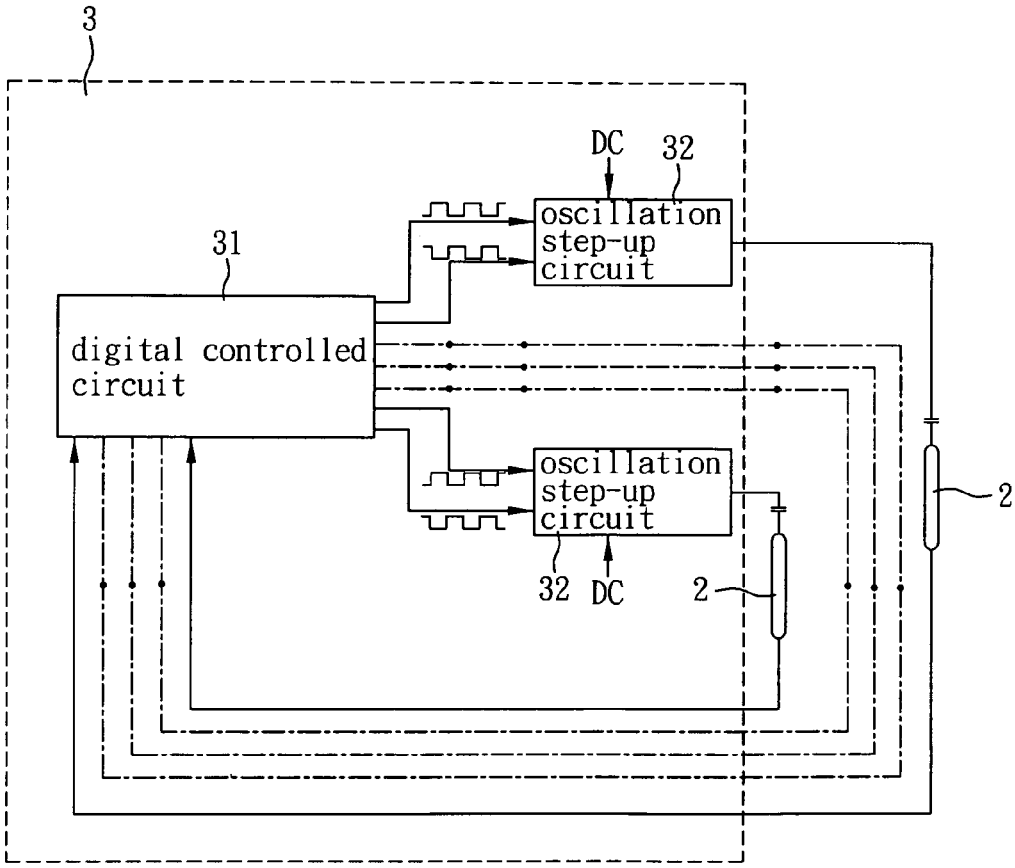
FIG. 2A (PRIOR ART)
FIG. 2A is a schematic block diagram showing a conventional digital light source driving apparatus.
Figure 2B:
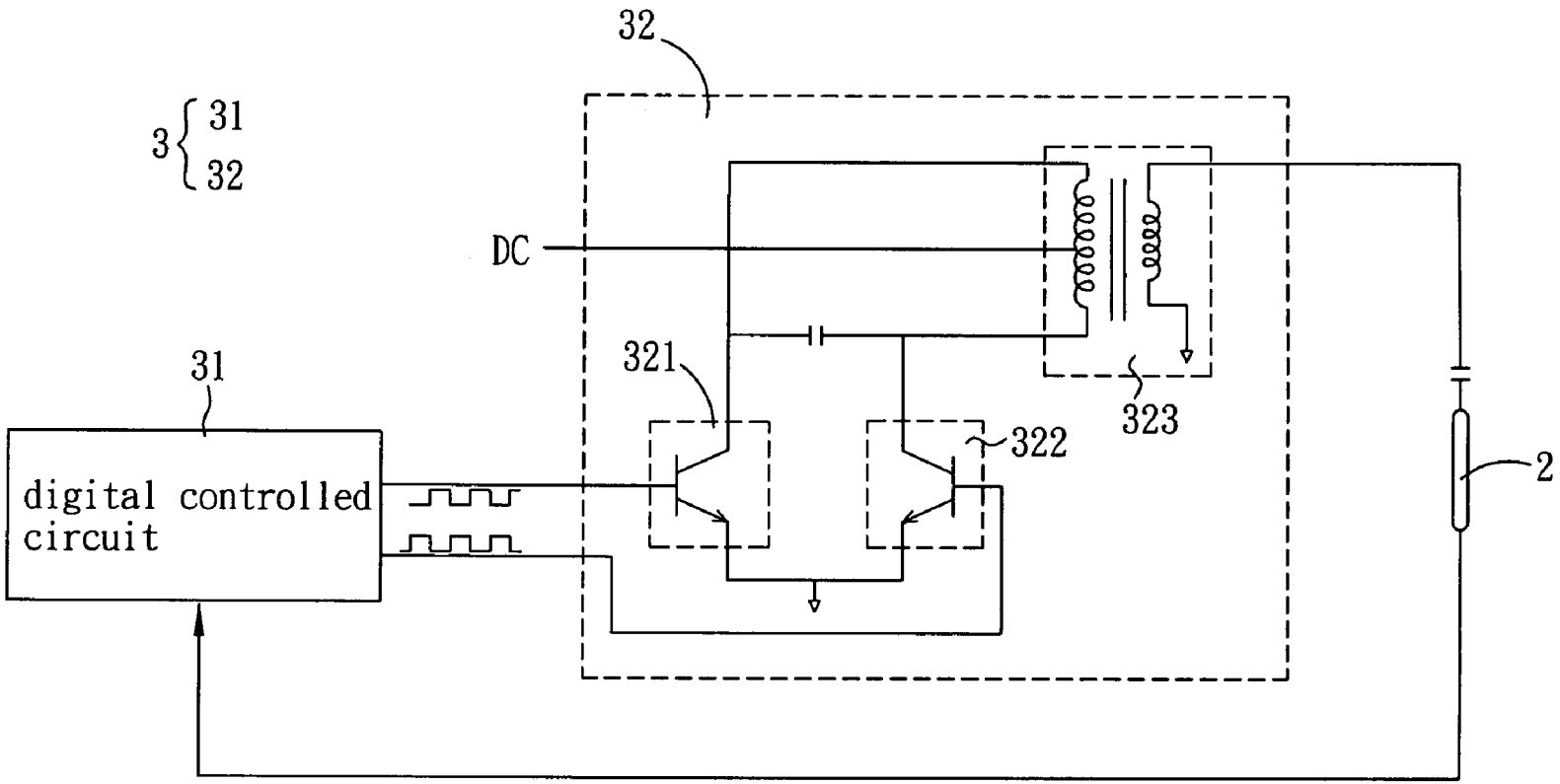
FIG. 2B (PRIOR ART)
FIG. 2B is a schematic illustration showing a main portion of the conventional digital light source driving apparatus.
Figure 3:
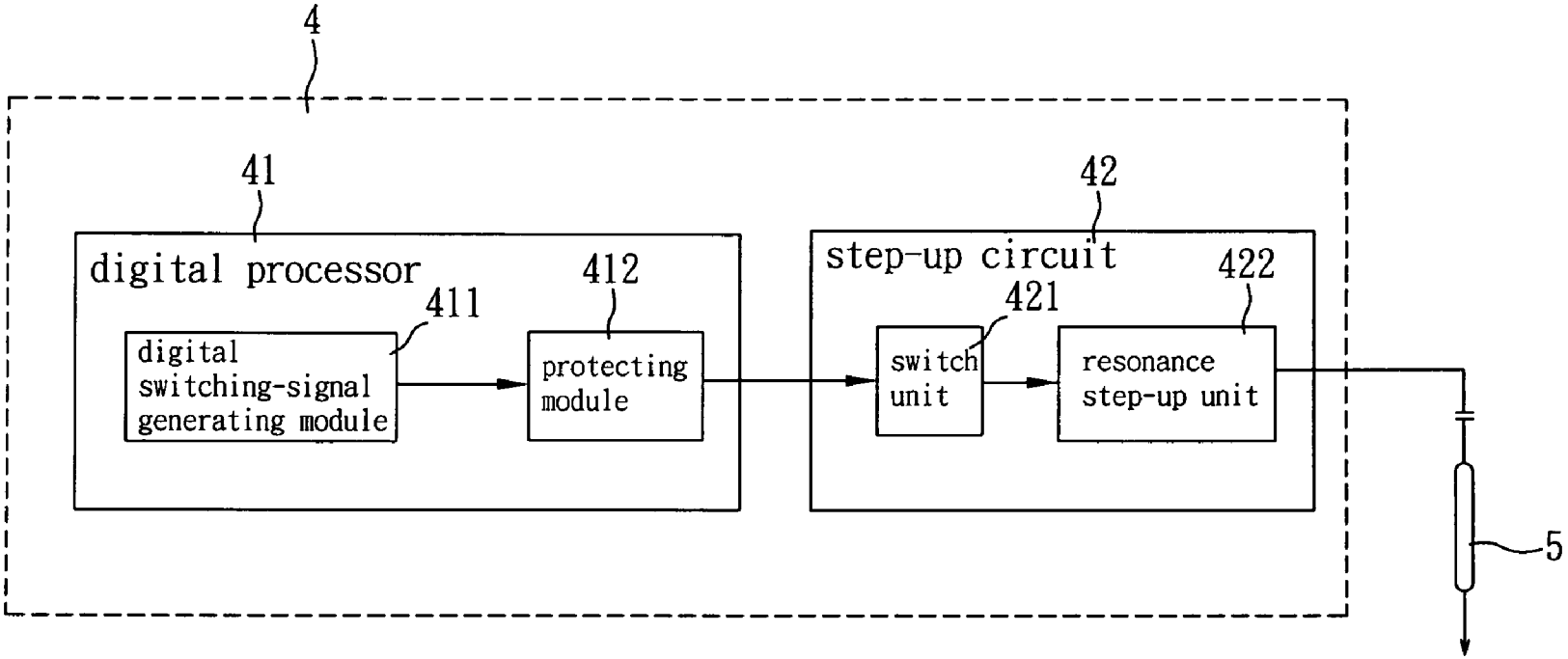
FIG. 3 is a schematic block diagram showing a digital light source driving apparatus according to a preferred embodiment of the invention.

As shown in FIG. 3, a digital controlled light source driving apparatus 4 according to the preferred embodiment of the invention includes a digital processor 41 and a step-up circuit 42.

The digital processor 41 has a digital switching-signal generating module 411 and a protecting module 412. The digital switching-signal generating module 411 generates and outputs at least one digital switching signal set $S_1$ to the protecting module 412. The phase and duty cycle of the digital switching signal set $S_1$ is controlled by the digital switching-signal generating module 411. Next, the protecting module 412 generates and outputs one protecting switching signal set $S_2$ to the step-up circuit 42 according to the digital switching signal set $S_1$. In this embodiment, the digital switching signal set $S_1$ includes a first digital switching signal $S_A$ and a second digital switching signal $S_B$, and the protecting switching signal set $S_2$ includes a first protecting switching signal $S_{AP}$ and a second protecting switching signal $S_{BP}$. The detailed functions of the first digital switching signal $S_A$, the second digital switching signal $S_B$, the first protecting switching signal $S_{AP}$ and the second protecting switching signal $S_{BP}$ will be describe later. It is to be noted that the digital processor 41 may be implemented by a single integrated circuit (i.e., a single chip). Of course, the digital switching-signal generating module 411 may also be implemented by the single integrated circuit in another embodiment.

The step-up circuit 42 is electrically connected to the protecting module 412 of the digital processor 41 and a light source 5, and generates a power signal $P_1$ according to the protecting switching signal set $S_2$ generated by the protecting module 412. The power signal $P_1$ drives the light source 5 to make the light source 5 emit light. Of course, the step-up circuit 42 may also drive a plurality of light sources 5 simultaneously. In this embodiment, the light source 5 is a cold cathode fluorescent lamp. Of course, the light source 5 may also be a flat lamp, an external electrode cold cathode fluorescent lamp (EEFL), or even a light emitting diode (LED).

In addition, the step-up circuit 42 includes a switch unit 421 and a resonance step-up unit 422. The switch unit 421 is electrically connected to the protecting module 412 of the digital processor 41 and performs switching operations according to the protecting switching signal set $S_2$ generated by the protecting module 412 so as to control the resonance step-up unit 422 to generate the power signal $P_1$ according to the switching operations.

Figure 4:
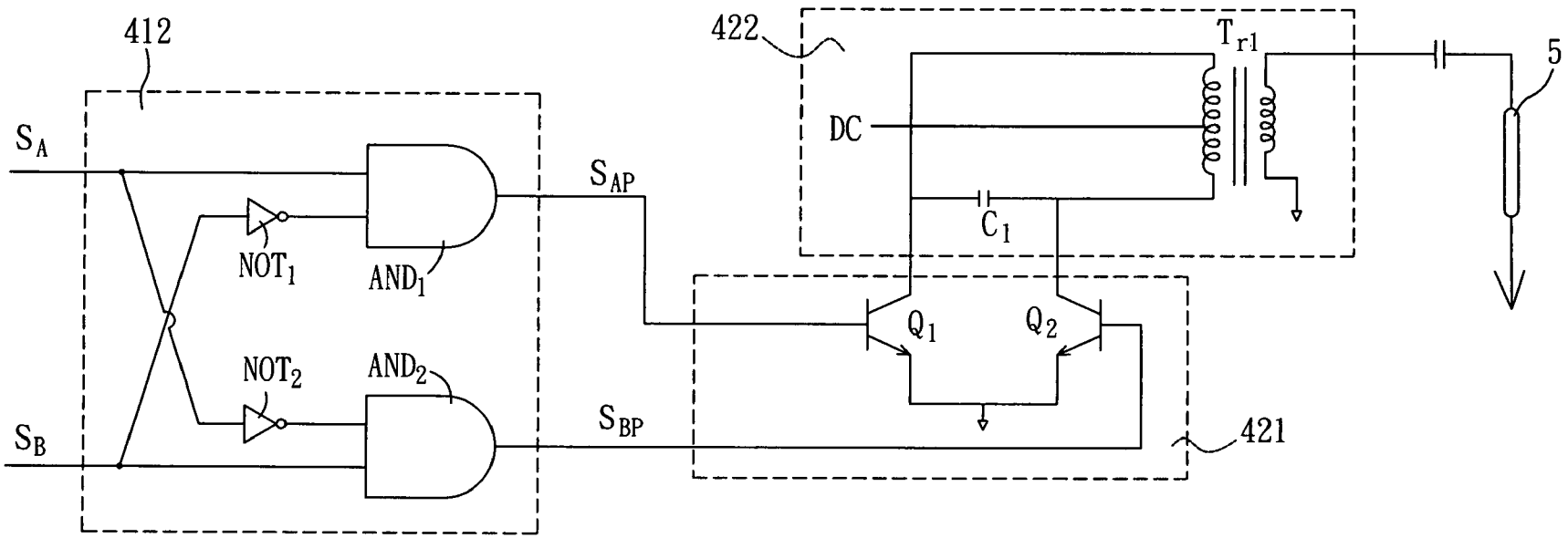
FIG. 4 is a schematic illustration showing a main portion of a protecting module and a step-up circuit of the digital light source driving apparatus according to the preferred embodiment of the invention.

The switch unit 421 may have the push-pull architecture, half bridge architecture or full bridge architecture. Referring to FIG. 4 in which the push-pull architecture is illustrated in this embodiment, the switch unit 421 includes a first switch element $Q_1$ and a second switch element $Q_2$. When each of the first switch element $Q_1$ and the second switch element is a bipolar junction transistor (BJT), the protecting switching signal set $S_2$ outputted by the protecting module 412 controls the bases of the first switch element $Q_1$ and the second switch element $Q_2$. It is to be noted that when each of the switch elements $Q_1$ and $Q_2$ is a field effect transistor (FET) or a MOSFET (not shown), the protecting switching signal set $S_2$ outputted by the protecting module 412 controls the gates of the field effect transistors or MOSFETs.

It is to be specified that the protecting switching signal set $S_2$ outputted by the protecting module 412 controls the second switch element $Q_2$ to be OFF when the first switch element $Q_1$ is ON, and controls the first switch element $Q_1$ to be OFF when the second switch element $Q_2$ is ON. Thus, it is possible to prevent two switch elements from being turned on simultaneously and burned out.

The resonance step-up unit 422 mainly includes a transformer $T_{r1}$ and a condenser $C_1$. Two ends of the condenser $C_1$ are electrically connected to collectors of the first switch element $Q_1$ and the second switch element $Q_2$ of the switch unit 421, respectively.

Referring still to FIG. 4, the protecting module 412 of the digital processor 41 has a plurality of logic gates disposed on the circuit level of the digital processor. In this embodiment, the protecting module 412 has a first AND gate $AND_1$, a second AND gate $AND_2$, a first NOT gate $NOT_1$ and a second NOT gate $NOT_2$. The output terminal of the first NOT gate $NOT_1$ is electrically connected to the input terminal of the first AND gate $AND_1$. The output terminal of the second NOT gate $NOT_2$ is electrically connected to the input terminal of the second AND gate $AND_2$. The output terminals of the first AND gate $AND_1$ and the second AND gate $AND_2$ are electrically connected to the first switch element $Q_1$ and the second switch element $Q_2$ of the switch unit 421, respectively. In addition, the first digital switching signal $S_A$ is inputted to the input terminals of the first AND gate $AND_1$ and the second NOT gate $NOT_2$, and the second digital switching signal $S_B$ is inputted to the input terminals of the second AND gate $AND_2$ and the first NOT gate $NOT_1$. The first digital switching signal $S_A$ and the second digital switching signal $S_B$ are modulated by the logic gates. Then, the first AND gate $AND_1$ outputs the first protecting switching signal $S_{AP}$ to the first switch element $Q_1$, and the second AND gate $AND_2$ outputs the second protecting switching signal $S_{BP}$ to the second switch element $Q_2$.

Figure 5:
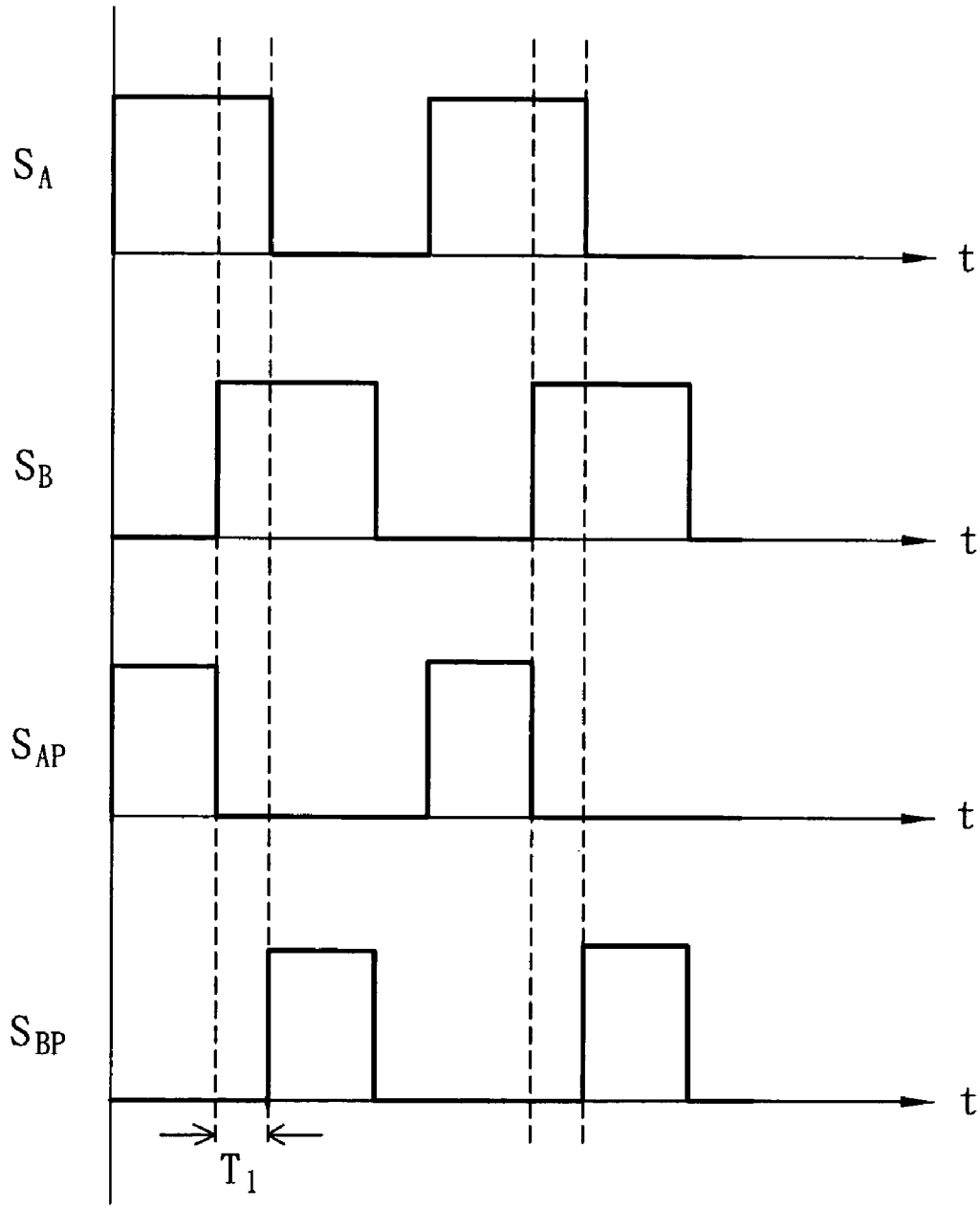
FIG. 5 is a schematic illustration showing waveforms of a first digital switching signal, a second digital switching signal, a first protecting switching signal and a second protecting switching signal in the digital light source driving apparatus according to the preferred embodiment of the invention.

The first digital switching signal $S_A$ and the second digital switching signal $S_B$ generated by the digital switching-signal generating module 411 in the normal state should control the second switch element $Q_2$ to be OFF when the first switch element $Q_1$ is ON, and control the first switch element $Q_1$ to be OFF when the second switch element $Q_2$ is ON. However, if the crash of the digital processor 41 makes the output of the switching signal abnormal, as shown in time $T_1$ of FIG. 5, the first digital switching signal $S_A$ and the second digital switching signal $S_B$ turn on the first switch element $Q_1$ and the second switch element $Q_2$ simultaneously. At this time, the switch elements will be burned out due to the short-circuited phenomenon. Thus, after the protecting module 412 modulates the first digital switching signal $S_A$ into the first protecting switching signal $S_{AP}$, and the second digital switching signal $S_B$ into the second protecting switching signal $S_{BP}$, as shown in time $T_1$ in the waveform of FIG. 5, the first switch element $Q_1$ and the second switch element $Q_2$ are OFF.

Thus, using the first protecting switching signal $S_{AP}$ and the second protecting switching signal $S_{BP}$ to control the first switch element $Q_1$ and the second switch element $Q_2$ can prevent the two switch elements from being turned on simultaneously and burned out, and prevent the digital controlled light source driving apparatus from being disabled.

Figure 6:
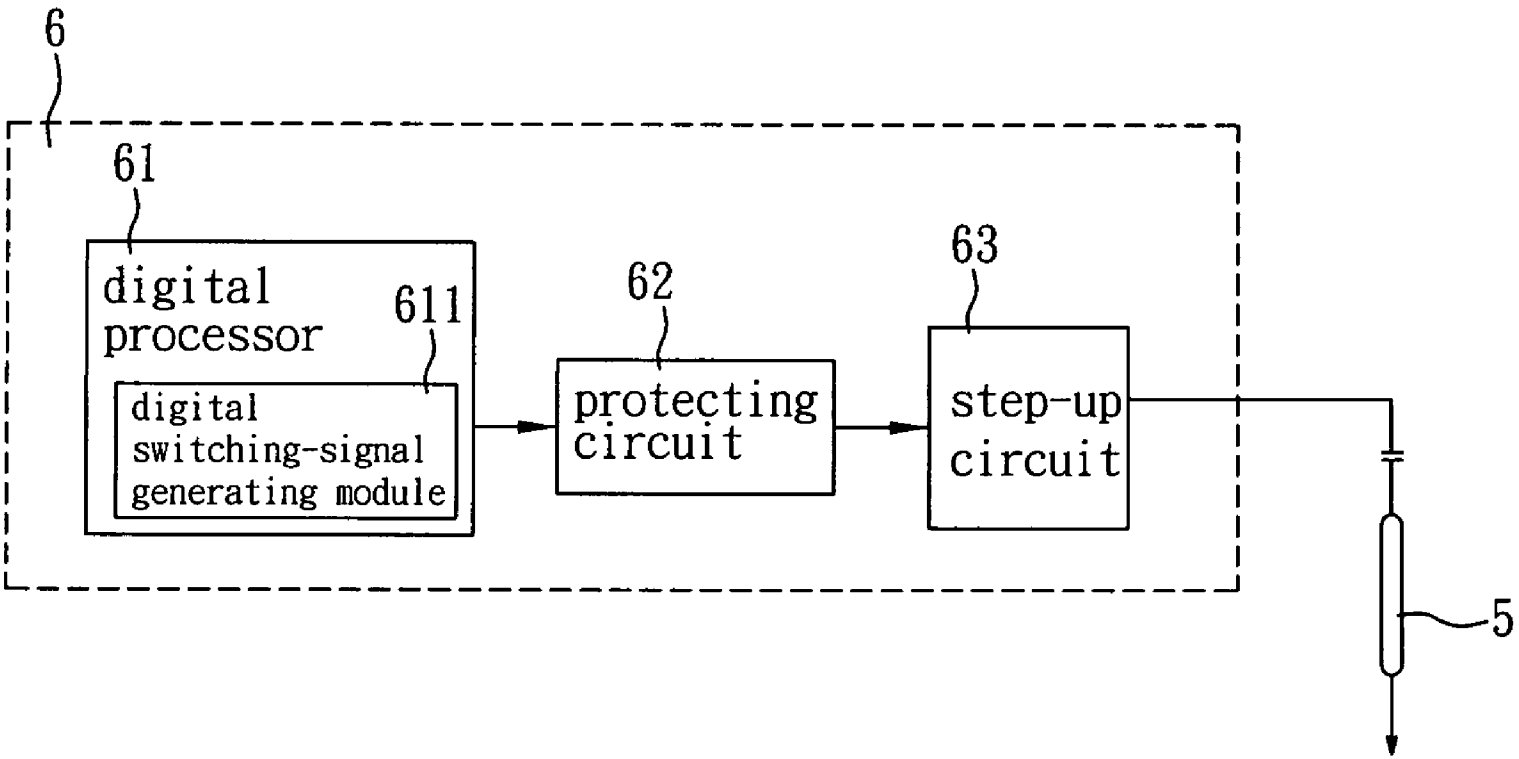
FIG. 6 is a schematic block diagram showing a digital light source driving apparatus according to another preferred embodiment of the invention.

Referring to FIG. 6, a digital controlled light source driving apparatus according to another embodiment of the invention includes a digital processor 61, a protecting circuit 62 and a step-up circuit 63.

The digital processor 61 has a digital switching-signal generating module 611 for generating one digital switching signal set. The protecting circuit 62 is electrically connected to the digital switching-signal generating module 611 of the digital processor 61. The protecting circuit 62 generates one protecting switching signal set according to the digital switching signal set. The step-up circuit 63 is electrically connected to the protecting circuit 62 and generates a power signal according to the protecting switching signal set generated by the protecting circuit 62. The power signal drives the light source 5 to emit light.

In these embodiments, the digital switching-signal generating module 611 of the digital processor 61 and the digital switching-signal generating module 411 of the digital processor 41 have the same effect. The step-up circuit 63 and the step-up circuit 42 have the same structure and effect, so detailed descriptions thereof will be omitted.

In addition, the protecting circuit 62 of this embodiment may be similar to the protecting module 412 of the previous embodiment and is thus composed of logic gates. Also, the protecting circuit 62 may be composed of active components and/or passive components to achieve the only object of generating the protecting switching signal set for preventing the switch elements of the step-up circuit 63 from being turned on simultaneously.

In summary, the digital controlled light source driving apparatus of the invention electrically connects the protecting module to the digital switching-signal generating module, and enables the protecting module to output the protecting switching signal set to the step-up circuit. When the digital processor generates the error switching signal set, the protecting module modulates the error switching signal set into the protecting switching signal set, which prevents the switch elements in the step-up circuit from being burned out. In addition, the protecting module may also be disposed outside the digital processor and formed into a protecting circuit. In this case, the protecting circuit may be composed of logic gates, as well as active components and/or passive components. Thus, the protecting circuit can prevent the digital controlled light source driving apparatus from being disabled due to the burned-out switch elements.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A digital controlled light source driving apparatus, comprising:

a digital processor having a digital switching-signal generating module for generating at least one digital switching signal set, and a protecting module for generating one protecting switching signal set according to the digital switching signal set; and a step-up circuit electrically connected to the protecting module of the digital processor for generating a power signal according to the protecting switching signal set, wherein the at least one digital switching signal set comprises a first digital switching signal and a second digital switching signal, and the protecting switching signal set comprises a first protecting switching signal and a second protecting switching signal, the protecting module prevents the first protecting switching signal and the second protecting switching signal from being enabled simultaneously when the first digital switching signal and the second digital switching signal are enabled simultaneously.

2. The apparatus according to claim 1, wherein the step-up circuit is electrically connected to a light source and drives the light source according to the power signal.

3. The apparatus according to claim 2, wherein the light source is a cold cathode fluorescent lamp, a flat lamp or an external electrode cold cathode fluorescent lamp.

4. The apparatus according to claim 1, wherein the step-up circuit comprises a switch unit and a resonance step-up unit, and the switch unit is electrically connected to the protecting module of the digital processor and performs switching operations according to the protecting switching signal set so as to control the resonance step-up unit according to the switching operations.

5. The apparatus according to claim 4, wherein the resonance step-up unit comprises a transformer or a piezoelectricity element.

6. The apparatus according to claim 4, wherein the switch unit comprises a first switch element and a second switch element, and the protecting switching signal set controls the second switch element to be OFF when the first switch element is ON, and controls the first switch element to be OFF when the second switch element is ON.

7. The apparatus according to claim 6, wherein each of the first switch element and the second switch element is a bipolar junction transistor or a field effect transistor.

8. The apparatus according to claim 6, wherein:

the protecting module has a first AND gate, a second AND gate, a first NOT gate and a second NOT gate;

an output terminal of the first NOT gate is electrically connected to an input terminal of the first AND gate;

an output terminal of the second NOT gate is electrically connected to an input terminal of the second AND gate; and an output terminal of the first AND gate and an output terminal of the second AND gate are electrically connected to the first switch element and the second switch element, respectively.

9. The apparatus according to claim 8, wherein the first digital switching signal is inputted to the input terminal of the first AND gate and an input terminal of the second NOT gate, and the second digital switching signal is inputted to the input terminal of the second AND gate and an input terminal of the first NOT gate.

10. A digital controlled light source driving apparatus, comprising:

a digital processor having a digital switching-signal generating module for generating at least one digital switching signal set;

a protecting circuit electrically connected to the digital processor and generating one protecting switching signal set according to the digital switching signal set; and a step-up circuit electrically connected to the protecting circuit and generating a power signal according to the protecting switching signal sets, wherein the at least one digital switching signal set comprises a first digital switching signal and a second digital switching signal, and the protecting switching signal set comprises a first protecting switching signal and a second protecting switching signal, the protecting circuit prevents the first protecting switching signal and the second protecting switching signal from being enabled simultaneously when the first digital switching signal and the second digital switching signal are enabled simultaneously.

11. The apparatus according to claim 10, wherein the step-up circuit is electrically connected to a light source and drives the light source according to the power signal.

12. The apparatus according to claim 11, wherein the light source is a cold cathode fluorescent lamp, a flat lamp or an external electrode cold cathode fluorescent lamp.

13. The apparatus according to claim 10, wherein the step-up circuit comprises a switch unit and a resonance step-up unit, and the switch unit is electrically connected to the protecting circuit and performs switching operations according to the protecting switching signal set so as to control the resonance step-up unit according to the switching operations.

14. The apparatus according to claim 13, wherein the resonance step-up unit comprises a transformer or a piezoelectricity element.

15. The apparatus according to claim 13, wherein the switch unit comprises a first switch element and a second switch element, and the protecting switching signal set controls the second switch element to be OFF when the first switch element is ON, and controls the first switch element to be OFF when the second switch element is ON.

16. The apparatus according to claim 15, wherein each of the first switch element and the second switch element is a bipolar junction transistor or a field effect transistor.

17. The apparatus according to claim 15, wherein:

the protecting circuit has a first AND gate, a second AND gate, a first NOT gate and a second NOT gate;

an output terminal of the first NOT gate is electrically connected to an input terminal of the first AND gate;

an output terminal of the second NOT gate is electrically connected to an input terminal of the second AND gate; and an output terminal of the first AND gate and an output terminal of the second AND gate are electrically connected to the first switch element and the second switch element, respectively.

18. The apparatus according to claim 17, wherein the first digital switching signal is inputted to the input terminal of the first AND gate and an input terminal of the second NOT gate, and the second digital switching signal is inputted to the input terminal of the second AND gate and an input terminal of the first NOT gate.

19. A digital controlled light source driving apparatus, comprising:

a digital processor having a digital switching-signal generating module for generating at least one digital switching signal set, and a protecting module for generating one protecting switching signal set according to the digital switching signal set; and a step-up circuit electrically connected to the protecting module of the digital processor for generating a power signal according to the protecting switching signal set, wherein the step-up circuit comprises a switch unit and a resonance step-up unit, and the switch unit is electrically connected to the protecting module of the digital processor and performs switching operations according to the protecting switching signal set so as to control the resonance step-up unit according to the switching operations, wherein the switch unit comprises a first switch element and a second switch element, and the protecting switching signal set controls the second switch element to be OFF when the first switch element is ON, and controls the first switch element to be OFF when the second switch element is ON, and wherein the at least one digital switching signal set comprises a first digital switching signal and a second digital switching signal, and the protecting switching signal set comprises a first protecting switching signal and a second protecting switching signal.

20. A digital controlled light source driving apparatus, comprising:

a digital processor having a digital switching-signal generating module for generating at least one digital switching signal set;

a protecting circuit electrically connected to the digital processor and generating one protecting switching signal set according to the digital switching signal set; and a step-up circuit electrically connected to the protecting circuit and generating a power signal according to the protecting switching signal set, wherein the step-up circuit comprises a switch unit and a resonance step-up unit, and the switch unit is electrically connected to the protecting circuit and performs switching operations according to the protecting switching signal set so as to control the resonance step-up unit according to the switching operations, wherein the switch unit comprises a first switch element and a second switch element, and the protecting switching signal set controls the second switch element to be OFF when the first switch element is ON, and controls the first switch element to be OFF when the second switch element is ON, and wherein the at least one digital switching signal set comprises a first digital switching signal and a second digital switching signal, and the protecting switching signal set comprises a first protecting switching signal and a second protecting switching signal.

* * * * *